US011602942B2

(12) United States Patent
Ito

(10) Patent No.: US 11,602,942 B2
(45) Date of Patent: Mar. 14, 2023

(54) RECORDING APPARATUS WITH A GUIDE MEMBER

(71) Applicant: Seiko Epson Corporation, Tokyo (JP)

(72) Inventor: Shun Ito, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/410,292

(22) Filed: Aug. 24, 2021

(65) Prior Publication Data

US 2022/0063309 A1 Mar. 3, 2022

(30) Foreign Application Priority Data

Aug. 27, 2020 (JP) ..... JP2020-143304

(51) Int. Cl.

| | |
|---|---|
| ***B41J 11/70*** | (2006.01) |
| ***B41J 15/16*** | (2006.01) |
| ***B65H 35/06*** | (2006.01) |
| ***B41J 11/42*** | (2006.01) |
| ***B41J 11/00*** | (2006.01) |

(Continued)

(52) U.S. Cl.

CPC ..... *B41J 11/706* (2013.01); *B41J 11/0045* (2013.01); *B41J 11/42* (2013.01); *B41J 13/106* (2013.01); *B41J 15/16* (2013.01); *B65H 18/103* (2013.01); *B65H 35/06* (2013.01); *B65H 35/04* (2013.01); *B65H 2301/122* (2013.01); *B65H 2301/515* (2013.01); *B65H 2404/143* (2013.01); *B65H 2404/612* (2013.01); *B65H 2701/1719* (2013.01); *B65H 2801/12* (2013.01)

(58) Field of Classification Search

CPC ..... B41J 11/706; B41J 11/0045; B41J 11/42; B41J 13/106; B41J 15/16; B65H 18/103; B65H 35/06; B65H 35/04; B65H 2301/122; B65H 2301/515; B65H 2404/143; B65H 2404/612; B65H 2701/1719; B65H 2801/12

See application file for complete search history.

(56) References Cited

U.S. PATENT DOCUMENTS

| | | | | |
|---|---|---|---|---|
| 9,242,486 | B2 * | 1/2016 | Verhofstad | B65H 18/103 |
| 2016/0136976 | A1 * | 5/2016 | Shinjo | B41J 15/16 347/104 |

(Continued)

FOREIGN PATENT DOCUMENTS

| | | |
|---|---|---|
| JP | 2018-149717 | 9/2018 |

*Primary Examiner* — Henok D Legesse
(74) *Attorney, Agent, or Firm* — Workman Nydegger

(57) ABSTRACT

A recording apparatus includes a recording unit configured to perform recording on a recording medium that is a long medium, a supporting part disposed opposite to the recording unit and configured to support the recording medium, a cutting part configured to cut the long medium into a single sheet medium, a guide member configured to guide the recording medium, a winding unit configured to wind up the long medium, and a medium housing unit configured to be detachable and house the single sheet medium. The guide member is displaceable to a first supporting position in which the guide member supports the recording medium being conveyed to the medium housing unit and a second supporting position in which the guide member supports the long medium being conveyed to the winding unit, the second supporting position being located above the first supporting position.

13 Claims, 10 Drawing Sheets

(51) Int. Cl.

| | |
|---|---|
| ***B65H 18/10*** | (2006.01) |
| ***B41J 13/10*** | (2006.01) |
| *B65H 35/04* | (2006.01) |

(56) References Cited

U.S. PATENT DOCUMENTS

| | | | | |
|---|---|---|---|---|
| 2018/0257406 | A1 | 9/2018 | Harigae et al. | |
| 2018/0327209 | A1* | 11/2018 | Asai ..... | B65H 31/02 |

* cited by examiner

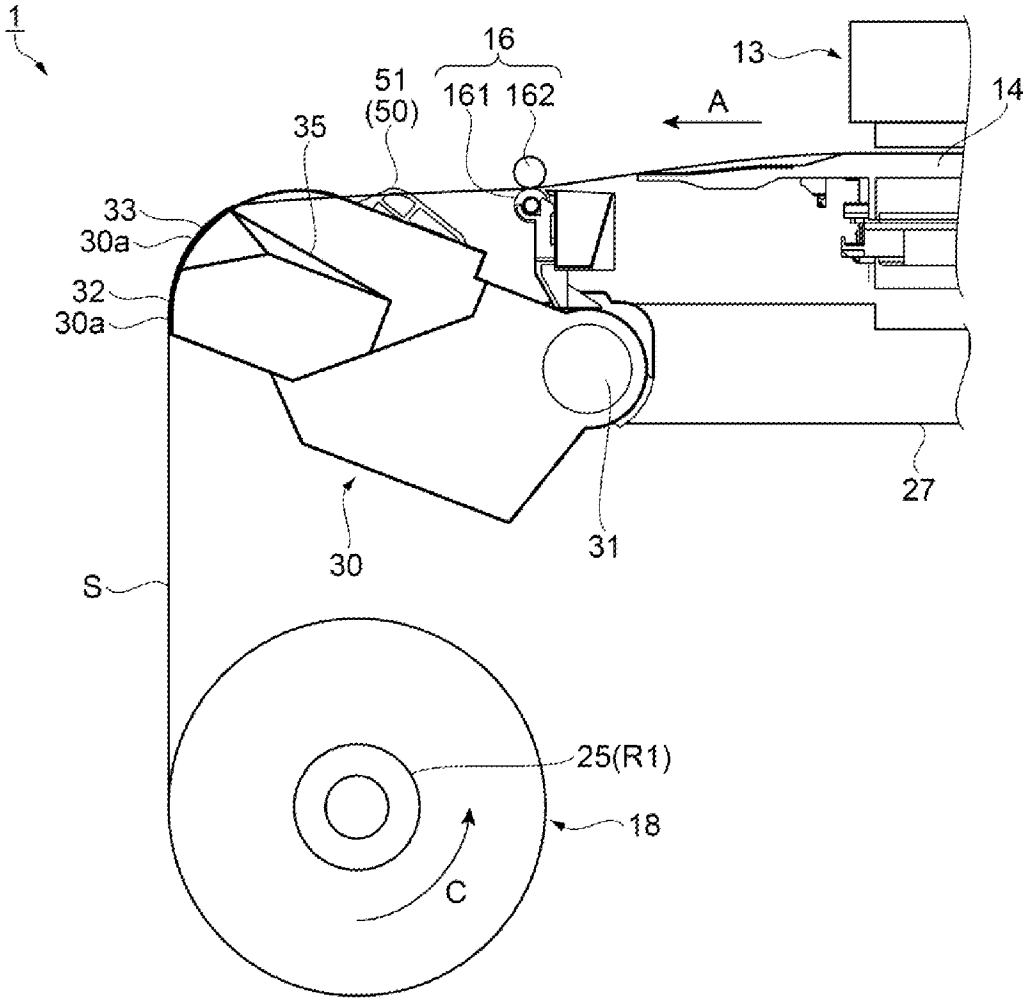
FIG. 10
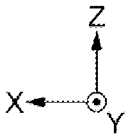

RECORDING APPARATUS WITH A GUIDE MEMBER

The present application is based on, and claims priority from JP Application Serial Number 2020-143304, filed Aug. 27, 2020, the disclosure of which is hereby incorporated by reference herein in its entirety.

BACKGROUND

1. Technical Field

The present disclosure relates to a recording apparatus.

2. Related Art

In the related art, a printing apparatus that performs printing on a roll sheet is known. For example, JP-A-2018-149717 discloses a printing apparatus with a guide member that supports a medium from below and guides the medium to a stacker provided on the lower side when a roll sheet is ejected.

JP-A-2018-149717 does not disclose a configuration in which the position of the guide member is displaced in accordance with the ejection destination of the medium to be ejected, the characteristics of the medium, and the like. As such, it cannot support a case where the ejection destination is the stacker or a roll-shaped tube, or operate in accordance with the medium type and the like, and consequently appropriate ejection cannot be performed.

SUMMARY

A recording apparatus includes a recording unit configured to perform recording on a recording medium that is a long medium having a roll shape, a supporting part disposed opposite to the recording unit and configured to support the recording medium, a cutting part configured to cut the long medium into a single sheet medium at a position downstream of the supporting part in a conveyance direction of the recording medium, a guide member configured to guide the recording medium at a position downstream of the cutting part in the conveyance direction, a winding unit configured to wind up the long medium at a position downstream of the guide member in the conveyance direction, and a medium housing unit configured to be detachable and house the single sheet medium at a position downstream of the guide member in the conveyance direction. The guide member is displaceable to a first supporting position in which the guide member supports the recording medium being conveyed to the medium housing unit and a second supporting position in which the guide member supports the long medium being conveyed to the winding unit, the second supporting position being located above the first supporting position.

BRIEF DESCRIPTION OF THE DRAWINGS

FIG. 10 is a side sectional view illustrating ejection of the recording medium in a case where the guide member is located at the second supporting position.

DESCRIPTION OF EXEMPLARY EMBODIMENTS

1. Embodiment

A schematic configuration of a recording apparatus 1 according to an embodiment is described below.

Figure 1:
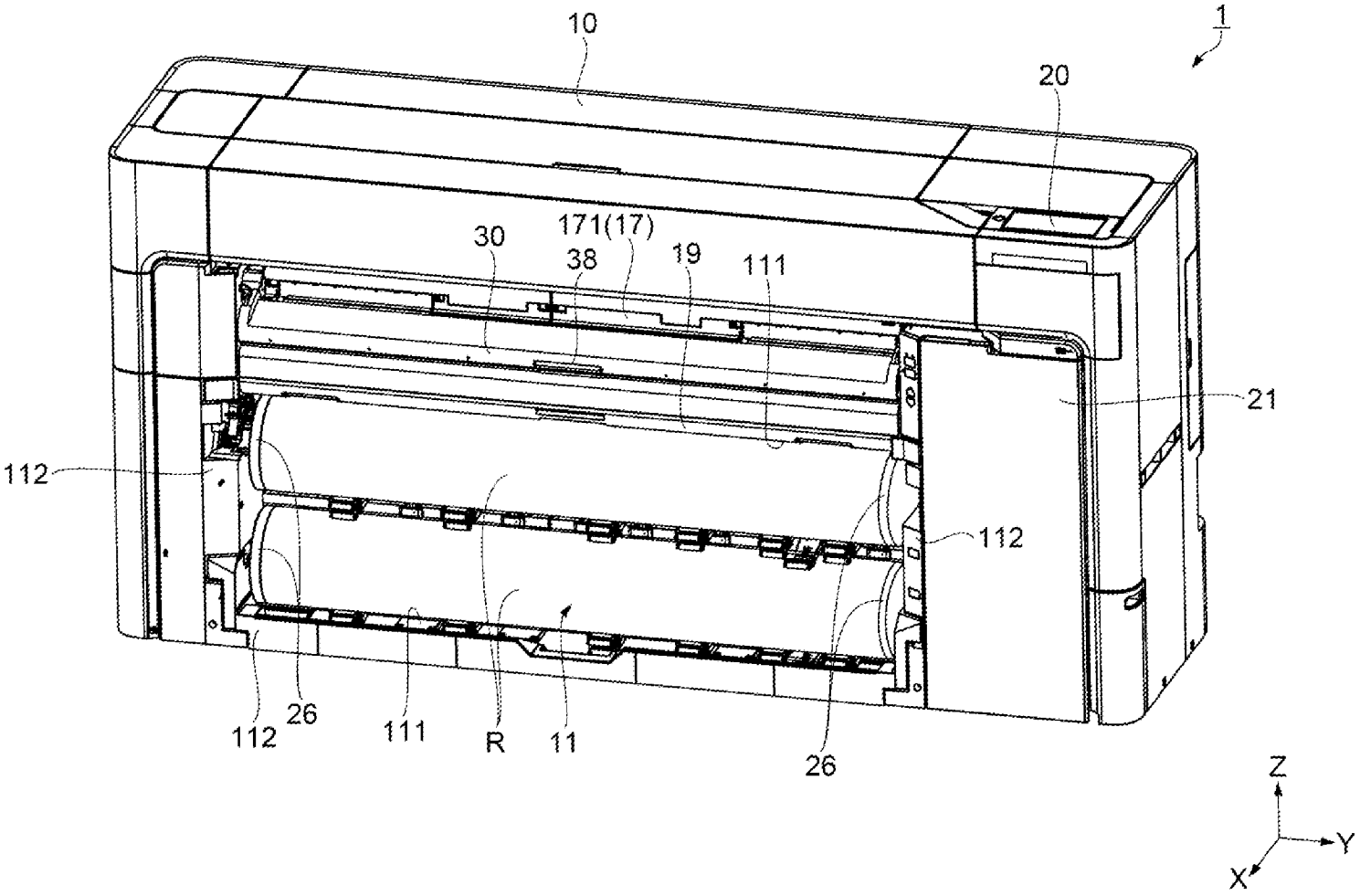
FIG. 1 is a perspective view of a recording apparatus according to an embodiment as viewed from a front surface side.
Figure 2:
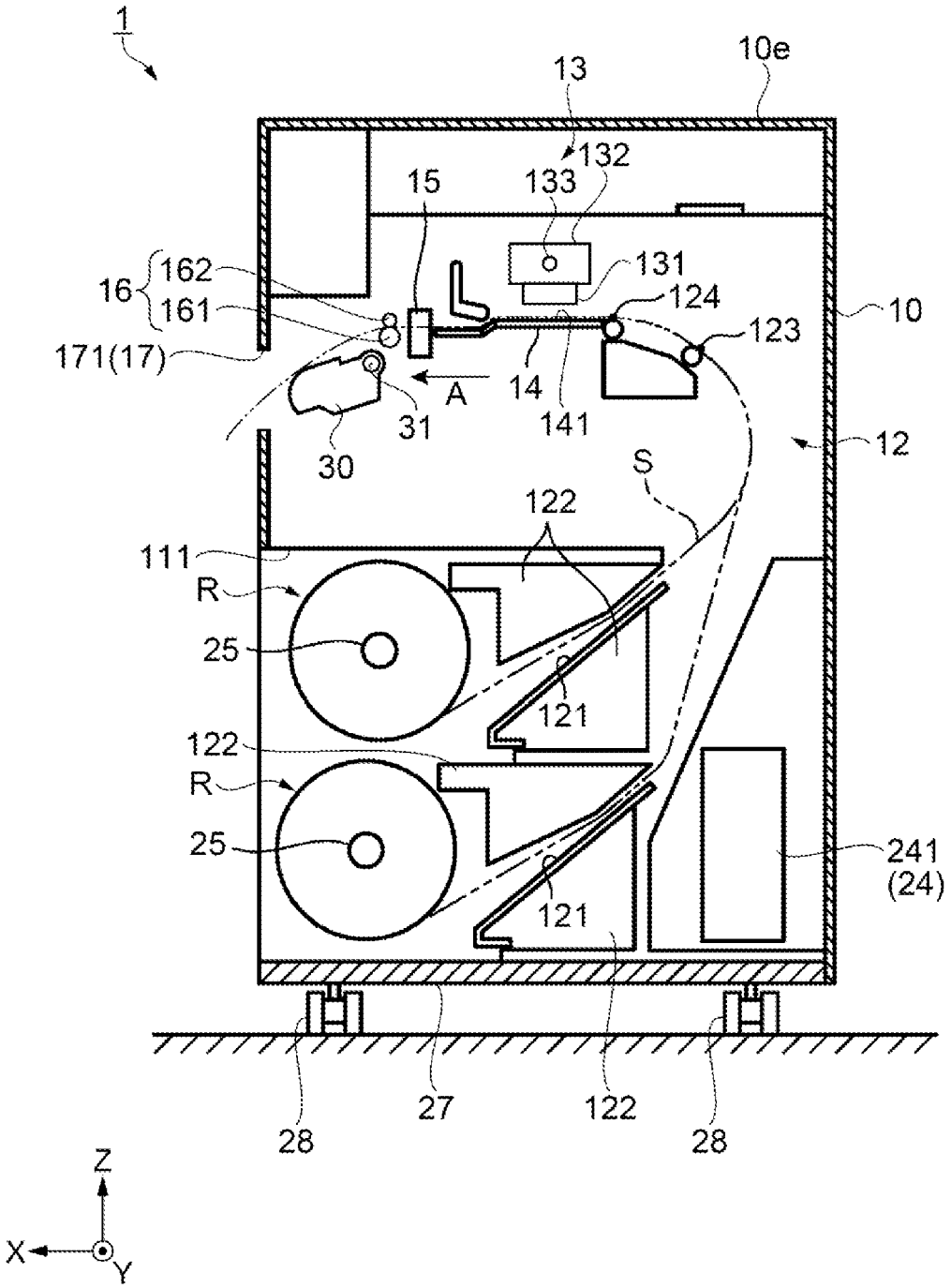
FIG. 2 is a schematic sectional view illustrating a schematic configuration of the recording apparatus.

The recording apparatus 1 of the present embodiment is an ink-jet recording apparatus that performs recording (printing) by discharging ink as liquid to a recording medium (sheet) that is a roll-shaped long medium. In addition, as illustrated in FIG. 1 and FIG. 2, the recording apparatus 1 uses a roll sheet R having a cylindrical shape in which a long medium S as a recording medium is wound in a roll shape around a cylindrical core member 25. The recording apparatus 1 of the present embodiment is a recording apparatus for large media that performs printing on the long medium S with a short side width of A3 (297 mm) or greater.

Specifically, there are a plurality of types of the long medium S that constitutes the roll sheet R. For example, long media S with high bending rigidity such as photographic paper, and long media S with lower bending rigidity than photographic paper such as plain paper are used. Also, there are a plurality of sizes of the long medium S. For example, long media S of A0 size to A3 size are used. In addition, the recording apparatus 1 of the present embodiment can perform recording not only with the roll sheet R as the recording medium, but also with rectangular single sheet paper, cardboard, and the like, by supplying them into a housing 10.

In the drawings described below, it is assumed that the recording apparatus 1 is placed on a horizontal plane. In addition, as the directions along the horizontal plane, the front-rear direction of the recording apparatus 1 is defined as the X direction and the left-right direction (or the width direction of the long medium S) orthogonal to the X direction is defined as the Y direction. In addition, the vertical direction (the up and down direction) with respect to the horizontal plane is defined as the Z direction. In addition, the front direction is defined as the +X direction, the rear direction is defined as the −X direction, the right direction is defined as the +Y direction, the left direction is defined as −the Y direction, and the upward direction is defined as the +Z direction, and the downward direction is defined as the −Z direction.

The following mainly describes the recording apparatus 1 with a long medium S sent out from the roll sheet R.

As illustrated in FIG. 1 and FIG. 2, the recording apparatus 1 includes the housing 10 having a cuboid shape, and a frame 27 that supports each part of the recording apparatus 1. The housing 10 is coupled with the frame 27. In addition, the frame 27 is supported by a plurality of casters 28 that constitute leg parts.

The recording apparatus 1 includes a housing unit 11 that houses the roll sheet R, a conveyance unit 12 that conveys, to a recording unit 13, the long medium S sent out from the roll sheet R housed in the housing unit 11, and the recording unit 13 that performs recording on the long medium S. In addition, the recording apparatus 1 includes a supporting part 14 that is disposed opposite to the recording unit 13 and supports the long medium S, and a cutting part 15 that cuts the long medium S that has been recorded on. Here, the long medium S cut into a single sheet medium is referred to as a single sheet medium S1 in the following description.

Note that the recording apparatus 1 of the present embodiment may cut the long medium S sent out from the roll sheet R after the recording, or may wind it up without cutting it. In addition, in the case where recording is performed on single sheet paper, cardboard, or the like, the cutting is not performed. Whether the cutting part 15 is operated or not is controlled based on a request input to an operation panel 20 by the user, an output mode stored in a control unit 24, and the like.

The recording apparatus 1 includes a sheet ejection unit 17 that ejects the long medium S (the single sheet medium S1) or the like cut at the cutting part 15 to the outside in the front direction of the housing 10. In a conveyance direction A of the long medium S, the recording apparatus 1 includes a guide member 30 that guides the long medium S at a position downstream of the supporting part 14 in the conveyance direction A. The guide member 30 guides the long medium S ejected from the sheet ejection unit 17.

Note that in the following description, a downstream position in the conveyance direction A is simply denoted as "downstream". Likewise, an upstream position in the conveyance direction A is simply denoted as "upstream".

The housing unit 11 includes an opening 111 at an approximate center in the left-right direction on the front side of the housing 10, and a space extending from the front side toward the rear side, and thus the housing unit 11 houses the roll sheet R in a detachable manner. In addition, the housing unit 11 houses two roll sheets R side by side in the height direction on the front side. Each roll sheet R is provided with holding members 26 that rotatably hold the roll sheet R at both end portions. Further, the holding members 26 are held in holding units 112 fixed to the opening 111 in the left-right direction and the downward direction. When driven by a driving unit (omitted in the drawing) into rotation, the holding members 26 rotate the roll sheet R held by the holding members 26 around a center axis of the core member 25.

The holding units 112 are separated into two on the upper side and the lower side for the roll sheet R on the upper side and the roll sheet R on the lower side. The holding unit 112 on the upper side is fixed to the opening 111, and the roll sheet R on the lower side is provided by inserting it to a predetermined position from the front side with the holding members 26 provided thereto. The holding unit 112 on the lower side is formed such that it is movable in the front-rear direction, and the roll sheet R on the lower side is provided in the housing unit 11 by drawing the holding unit 112 to the front side, inserting the roll sheet R provided with the holding member 26 to a predetermined position in the holding unit 112 from the upper side, and then pushing back the holding unit 112 to the rear side. In addition, each roll sheet R can be removed from the housing unit 11 (the holding unit 112) by reversing the procedure used to provide each one.

The conveyance unit 12 conveys, toward the supporting part 14 (the recording unit 13), the long medium S sent out from the roll sheet R. The conveyance unit 12 includes a conveyance path formation part 122, an intermediate roller pair 123, a conveyance roller pair 124, and the like. The conveyance unit 12 conveys the long medium S to the supporting part 14 through conveyance path 121 and conveys it over a support surface 141 serving as the top surface of the supporting part 14 toward the sheet ejection unit 17 by driving the intermediate roller pair 123 and the conveyance roller pair 124 into rotation by the forward drive of a drive motor (omitted in the drawing).

Note that FIG. 2 illustrates a state where the long medium S is sent out from both of the two roll sheets R, but the long medium S is sent out from one roll sheet R in actual printing. In addition, in the recording apparatus 1 of the present embodiment, the core member 25 provided with the holding member 26 can be provided by removing one (in the present embodiment, the upper) roll sheet R from the holding unit 112. Further, it can be used as a winding unit 18 for performing recording by sending out the long medium S from the other (in the present embodiment, the lower) roll sheet R, and winding up the long medium S whose recording has been completed around the core member 25 provided at the holding unit 112 without cutting the long medium S. Details are described later.

As illustrated in FIG. 2, the recording unit 13 performs recording (printing) on the long medium S. The recording unit 13 includes a head 131 that discharges ink toward the long medium S, a carriage 132 on which the head 131 is mounted, and a guide rail 133 disposed along the width direction. In addition, the recording unit 13 includes a movement mechanism (omitted in the drawing) that moves the carriage 132 back and forth along the guide rail 133. Note that the supporting part 14 that supports the long medium S at the support surface 141 is disposed at a position opposite to the head 131. Together with the carriage 132, the head 131 performs recording on the long medium S supported by the supporting part 14 by discharging ink while moving back and forth in the width direction of the long medium S.

The recording apparatus 1 includes the cutting part 15, an ejection roller pair 16, and the guide member 30 at a position downstream of the long medium S with respect to the supporting part 14. The supporting part 14 (the support surface 141), facing the region where the head 131 of the recording unit 13 moves back and forth, is formed to extend in the left-right direction and the front-rear direction, and also extend to the vicinity of the cutting part 15 provided on the downstream side.

As illustrated in FIG. 2, the cutting part 15 cuts the long medium S for which recording has been completed. The cutting part 15 is located on the rear surface side of the sheet ejection unit 17 and on the front surface side of the recording unit 13. The cutting part 15 cuts the long medium S across the width direction at a cutting position by moving a cutting blade (omitted in the drawing) back and forth in the width direction (left-right direction).

The ejection roller pair 16 is provided at a position downstream of the cutting part 15. The ejection roller pair 16 is composed of a driving roller 161 for driving, and a driven roller 162 that rotates to follow the rotation of the driving roller 161. When ejecting a recording medium, the ejection roller pair 16 sandwiches the recording medium between the driving roller 161 and the driven roller 162.

The guide member 30 is provided at a position immediately downstream of the ejection roller pair 16. The guide member 30 supports the long medium S that has passed through the supporting part 14, and guides the long medium S to the sheet ejection unit 17. The guide member 30, which constitutes the sheet ejection unit 17, is exposed to the front side of the housing 10. Note that by driving the ejection roller pair 16 into rotation by the forward drive of the drive motor (omitted in the drawing), the long medium S is guided by the guide member 30 and ejected from an outlet 171 of the sheet ejection unit 17.

Between the guide member 30 and the housing unit 11 (the opening 111) in the up and down direction, a simple stacker 19 having a simple configuration is housed inside the housing 10. The simple stacker 19 is, for example, formed in a rectangular frame shape with substantially the same length in the left-right direction as that of the guide member 30, and a cloth net (omitted in the drawing) wound by a winding mechanism (omitted in the drawing) and configured to house the single sheet medium S1 is provided inside the simple stacker 19. The simple stacker 19 is movable to the front side. Note that the front end surface of the simple stacker 19 does not protrude from the housing 10 in a state where it is housed inside the housing 10.

When the simple stacker 19 is used, the simple stacker 19 is drawn to the front side and used in a state where the simple stacker 19 is completely drawn. Note that along with the movement of the simple stacker 19 to the front side, the net is unwound from the winding apparatus. When the single sheet medium S1 is ejected from the outlet 171 in this state, the long medium S is housed in the net (omitted in the drawing) hanging in a recessed shape in the front-rear direction of the simple stacker 19. Note that the simple stacker 19 is not a member that must be used at the time of the ejection. When the simple stacker 19 is not used, it is housed inside the housing 10 by performing a reverse operation which is the reverse of the above-described operation. Note that the net is configured to be wound by the winding mechanism by moving the simple stacker 19 to the rear side.

An ink cover 21 is turnably provided on the right front side of the housing unit 11 (the opening 111) of the housing 10. The ink cover 21 is configured such that the interior of the ink cover 21 is exposed when the right end side is turned to the front side around the turning shaft (omitted in the drawing) provided in the up and down direction on the left end side. When the right end side of the ink cover 21 is turned to the front side, a cartridge holder where an ink cartridge that houses ink as an example of liquid is detachably provided (which are omitted in the drawing) is exposed. In this state, the user can replace the ink cartridge from the front side of the recording apparatus 1.

The operation panel 20 where an operation instruction to the recording apparatus 1 can be made is provided in a front right end portion in a top surface 10*e* of the housing 10. The operation panel 20 has a tilt mechanism (omitted in the drawing), and therefore can be used by tilting the operation panel 20 to a position where the operation panel 20 is easy to operate. The user can provide an operation instruction such as an output mode to the recording apparatus 1 from the front side.

The recording apparatus 1 includes the control unit 24. The control unit 24 is formed as an electric circuit composed of a plurality of electronic components. The control unit 24 is configured in a circuit board 241 provided in a rear lower portion of the housing 10. The control unit 24 is electrically coupled with the operation panel 20, and performs control of the recording apparatus 1 based on an operation instruction input by the user. The control unit 24 generally controls an operation of each part that constitutes the recording apparatus 1. The control unit 24 can display and/or notify information to the user through the operation panel 20, which also serves as a display unit, or indicators (omitted in the drawing), a sound notification unit (omitted in the drawing), and the like.

A configuration of the guide member 30 is described below.

As described above, the guide member 30 is provided at a position immediately downstream of the ejection roller pair 16, and guides the long medium S to the sheet ejection unit 17. The guide member 30 of the present embodiment includes a turning shaft 31 on the upstream side, and can be displaced (rotated) to three positions around the turning shaft 31.

Figure 6:
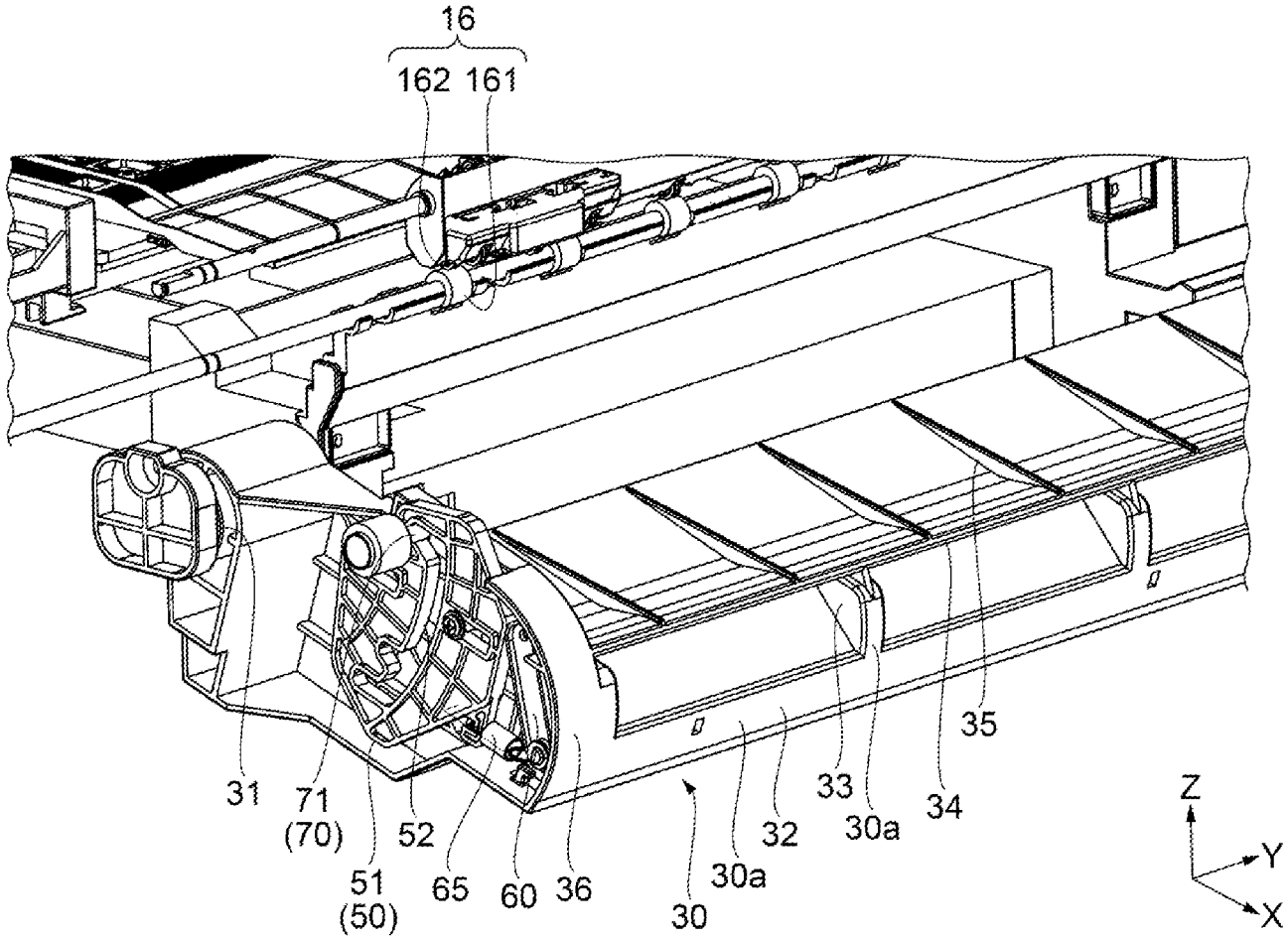
FIG. 6 is an overall perspective view illustrating the first supporting position of the guide member.

FIG. 6 is an overall perspective view illustrating a first supporting position of the guide member 30, and is a perspective view of the guide member 30 as viewed from a left front side.

As illustrated in FIG. 6, the guide member 30 is formed along the width direction with the same width as that of the outlet 171. At the front surface, the guide member 30 includes a first guide part 32 having a curved surface formed with a predetermined curvature in a side view, and the curved surface is contiguous across the width direction. On the upper side of the first guide part 32, a plurality of second guide parts 33 are formed at a predetermined pitch across the width direction. Each of the second guide parts 33 is formed in a rib shape protruding upward in the front-rear direction with an end surface contiguous with the same curved surface as that of the curved surface of the first guide part 32.

A plate-shaped wall part 34 with a gentle recessed shape in a side view is formed across the width direction and the upstream side from the upper end portion of the second guide part 33 contiguous with the curved surface of the first guide part 32. The wall part 34 is tilted downward in a direction toward the upstream side (the rear side). At the top surface of the wall part 34, a plurality of third guide parts 35 is formed at a predetermined pitch across the width direction. Each of the third guide parts 35 is formed in a rib shape protruding upward in the front-rear direction with a straight end surface.

Note that the curved surfaces of the first guide part 32 and the second guide part 33 function as a guide surface 30*a* that guides the long medium S being conveyed. The curvature of the curved surface (the guide surface 30*a*) of the first guide part 32 and the second guide part 33 of the guide member 30 is smaller than the curvature of the outer periphery of the roller driving roller 161 disposed on the lower side in the ejection roller pair 16.

An end portion 36 on both sides of the guide member 30 in the width direction has a curved surface with the same curvature as that of the curved surface (the guide surface 30*a*) of the first guide part 32. The end portion 36 is formed to extend upward of the second guide part 33 in an R-shape in a side view from the front side to the upper side. In addition, as illustrated in FIG. 3 to FIG. 5, the end portions 36 on both sides are formed in a state surrounding the turning shaft 31 provided to the frame 27 on the upstream side.

Figure 3:
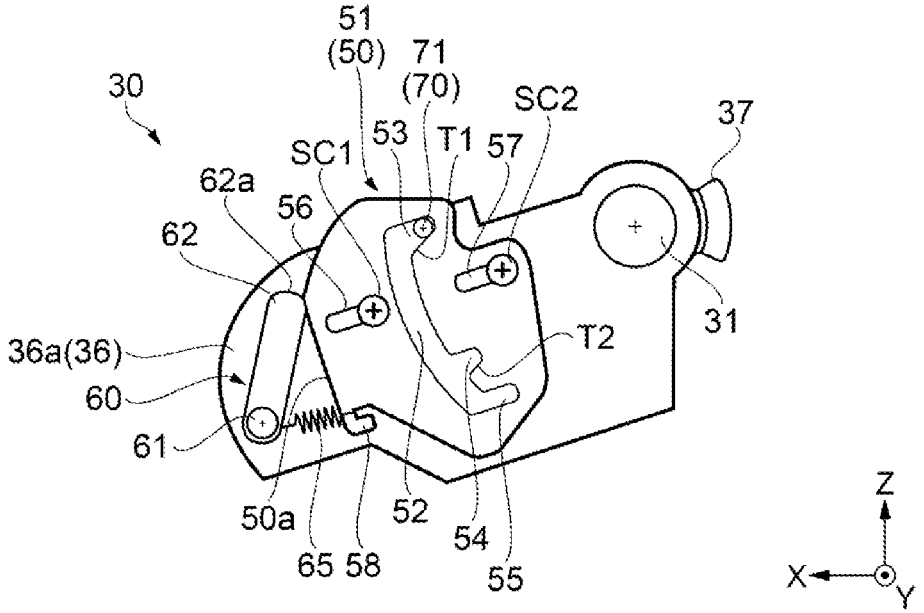
FIG. 3 is a schematic side view illustrating an operation of an engaging part and an engagement reception part for displacing a guide member.
Figure 4:
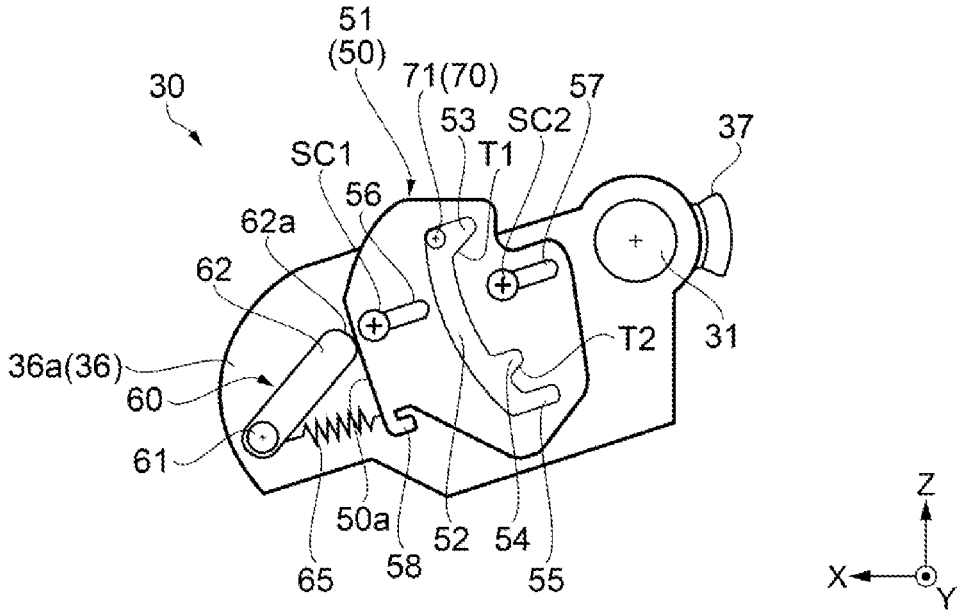
FIG. 4 is a schematic side view illustrating an operation of the engaging part and the engagement reception part for displacing a guide member.
Figure 5:
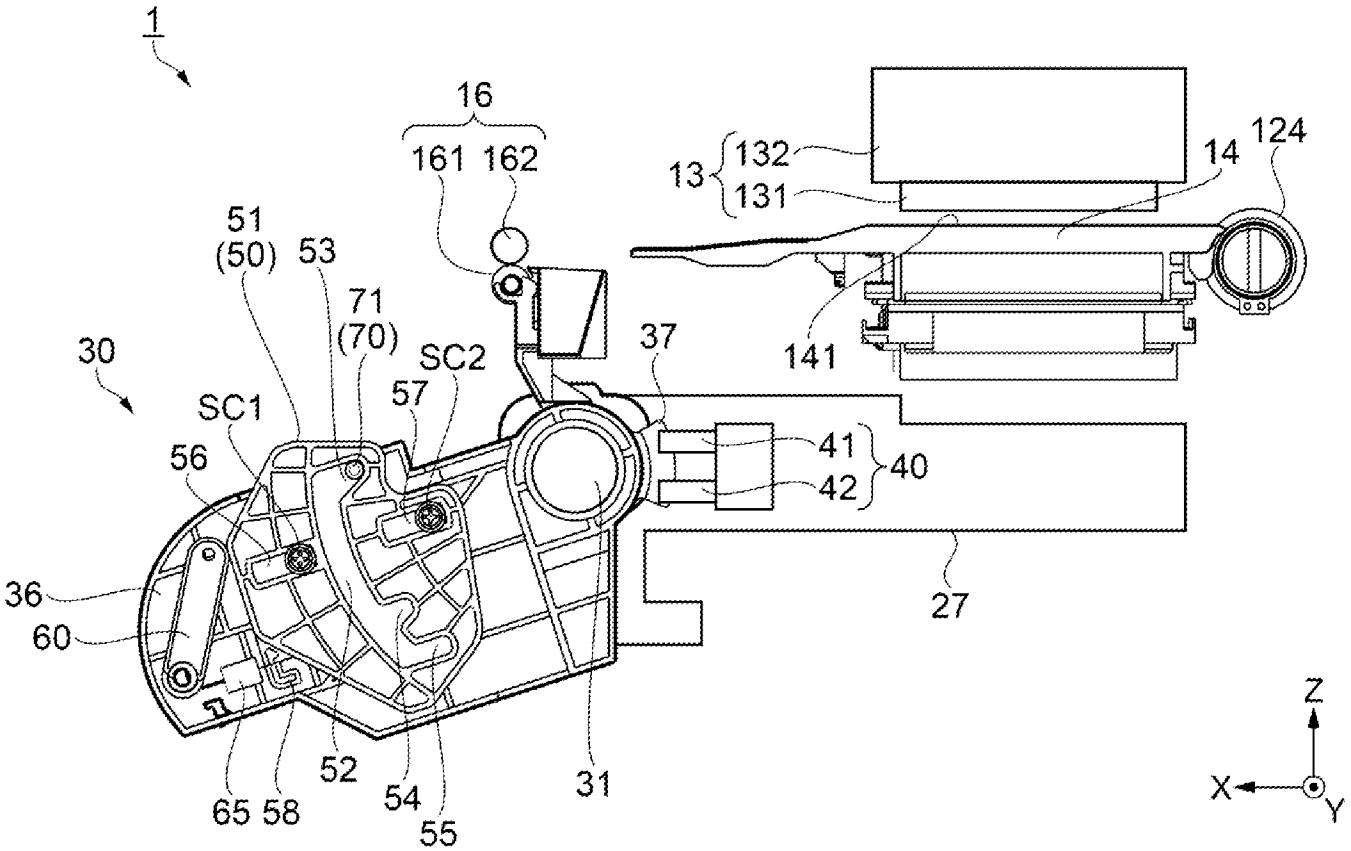
FIG. 5 is a schematic side view illustrating a first supporting position of the guide member.

As illustrated in FIG. 3 to FIG. 5, in each of the end portions 36 on both sides of the guide member 30, an engaging part 50 is configured as a mechanism for turning the guide member 30 around the turning shaft 31 and displacing the position of the guide member 30 itself. In addition, an engagement reception part 70 (an engagement reception pin 71) that receives the engaging part 50 is fixed to the frame 27. The mechanisms for displacing the position of the guide member 30 itself configured at the end portions 36 on both sides of the guide member 30 have the same configuration, and therefore the mechanism configured at the end portion 36 on the right side is described below.

The guide member 30 is positioned at each position (three positions) by displacing it using the engaging part 50 and engaging it with the engagement reception part 70 fixed to the frame 27.

The engaging part 50 is provided downstream of the turning shaft 31 at a side surface 36*a* of the end portion 36 on the right side. The engaging part 50 includes a plate-shaped engagement plate 51 with a polygonal external shape. In the engagement plate 51, a displacement slit hole 52 with a shape of a concentrical slit around the turning shaft 31 is formed in the up and down direction in the center portion. Further, three slit holes, a first engagement slit hole 53, a second engagement slit hole 54 and a third engagement slit hole 55, are formed as slit-shaped holes extended rearward and coupled with the displacement slit hole 52.

The first engagement slit hole 53 is formed at an upper end portion of the displacement slit hole 52, and the third engagement slit hole 55 is formed at a lower end portion of the displacement slit hole 52. The second engagement slit hole 54 is formed on a side closer to the third engagement slit hole 55 between the first engagement slit hole 53 and the third engagement slit hole 55. The first engagement slit hole 53 corresponds to a position for fixing the guide member 30 at a first supporting position described later. The second engagement slit hole 54 corresponds to a position for fixing the guide member 30 at a second supporting position described later. The third engagement slit hole 55 corresponds to a position for fixing the guide member 30 at an open position described later.

When the guide member 30 turns around the turning shaft 31, the fixed engagement reception pin 71 is located at the displacement slit hole 52. To displace (rotate) and fix the guide member 30 to the two supporting positions and the one open position, it is rotated such that the engagement reception pin 71 is located at any of the three slit holes (the first engagement slit hole 53 to the third engagement slit hole 55).

In the engagement plate 51, a first slide hole 56 and a second slide hole 57 are formed. The first slide hole 56 and the second slide hole 57 serve as slide holes for sliding the engagement plate 51 to the upstream side to position the engagement reception pin 71 at the displacement slit hole 52 when the guide member 30 is displaced. The first slide hole 56 and the second slide hole 57 are formed as long holes extending toward the axial center of the turning shaft 31.

A first fixation screw SC1 and a second fixation screw SC2, corresponding to the first slide hole 56 and the second slide hole 57, are provided in the side surface 36*a* of the end portion 36. Note that diameters of the heads of the first fixation screw SC1 and the second fixation screw SC2 are configured with sizes larger than the widths in the short direction of the first slide hole 56 and the second slide hole 57, respectively. In this manner, the engagement plate 51 is fixed to the side surface 36*a* of the end portion 36, such that it is slidable to the upstream side and the downstream side with respect to the first fixation screw SC1 and the second fixation screw SC2.

In addition, to displace the guide member 30, it is necessary to release the engagement of the engagement plate 51 and the engagement reception pin 71 in the engaging state by sliding the engagement plate 51. An engagement releasing plate 60 is a member for releasing the engagement by sliding the engagement plate 51. The engagement releasing plate 60 is formed in a bar-plate shape provided downstream of the engagement plate 51. The engagement releasing plate 60 includes a turning shaft 61 at a lower end portion. An upper end portion 62 is formed as an end surface 62*a* with a curved surface.

Note that in the engagement plate 51, a spring fixing part 58 for fixing one end portion of a coil spring 65 is formed at a position on the lower downstream side. In addition, at the side surface 36*a* of the end portion 36, a spring fixing part (omitted in the drawing) for fixing the other end portion of the coil spring 65 is formed.

Here, FIG. 3 and FIG. 4 are schematic side views illustrating an operation of the guide member 30. Specifically, FIG. 3 illustrates the engagement plate 51, the engagement reception pin 71, the engagement releasing plate 60 and the like in the case where the guide member 30 is fixed to the first supporting position. FIG. 4 illustrates operations of the engagement plate 51, the engagement reception pin 71, and the engagement releasing plate 60 in the case where the guide member 30 is displaced from the first supporting position to the second supporting position, or the open position.

As illustrated in FIG. 1, in the guide member 30, a handle 38 is formed on the lower side in a center portion in the left-right direction of the guide member 30. To displace the guide member 30, the user inserts their hand into the handle 38 and moves, to the front side, a lever (omitted in the drawing) provided inside. Inside the guide member 30, the lever is coupled with the engagement releasing plate 60 through a joint member (omitted in the drawing) and the like, and, when the lever is moved to the front side, the engagement releasing plate 60 rotates clockwise around the turning shaft 61 in plan view from the right side as illustrated in FIG. 4.

Through this operation, as illustrated in FIG. 4, the end surface 62*a* of the engagement releasing plate 60 slides on an end surface 50*a* of the engagement plate 51 while pressing the end surface 50*a*. In response to this, the engagement plate 51 moves to the upstream side along the first slide hole 56 and the second slide hole 57 with respect to the first fixation screw SC1 and the second fixation screw SC2 and against the tensile force of the coil spring 65.

In addition, as illustrated in FIG. 3 to FIG. 5, in the end portion 36 of the guide member 30, a fan-shaped light shielding plate 37 is formed to protrude upstream at a position upstream of the turning shaft 31. As illustrated in FIG. 5, when the guide member 30 is located at the predetermined supporting positions and open position, the light shielding plate 37 is used to detect the position by blocking the light of an optical detection sensor 40 described later.

Next, a case where the guide member 30 is located at the first supporting position is described.

FIG. 5 illustrates a case where the guide member 30 is located at the first supporting position.

In the recording apparatus 1, the first supporting position is a position where the guide member 30 is initially set. The recording apparatus 1 is used mainly with the guide member 30 set at the first supporting position. The first supporting position is a position of a case where the long medium S with a small bending rigidity such as plain paper sent out from the roll sheet R is cut at the cutting part 15 and ejected to the outlet 171 as the single sheet medium S1. At the first supporting position, the engagement plate 51 of the guide member 30 engages the engagement reception pin 71 in the first engagement slit hole 53.

An operation of a case where the guide member 30 is displaced from another position to the first supporting position is described below.

First, the user operates the engagement releasing plate 60 and slides the engagement plate 51 to the upstream side by inserting their hand into the handle 38 at the front side of the guide member 30 and moving the lever to the front side. In this manner, the engagement reception pin 71 engaged at another position moves to the displacement slit hole 52. In other words, the engagement reception pin 71 located at the second engagement slit hole 54 or the third engagement slit hole 55 moves to the displacement slit hole 52 by sliding the engagement plate 51 to the upstream side.

Thereafter, the user supports and pushes down the handle 38 such that the guide member 30 is at the first supporting position. At this time, the user may not move the lever to the front side. Through this operation, the guide member 30 rotates downward around the turning shaft 31, and the engagement reception pin 71 hits the upper end portion of the displacement slit hole 52.

When the engagement reception pin 71 hits the upper end portion of the displacement slit hole 52, the engagement reception pin 71 is located at the first engagement slit hole 53 coupled with the upper end portion of the displacement slit hole 52, and the engagement releasing plate 60 is returned to the initial position (see FIG. 3) with the pulling force of the coil spring 65. Additionally, the engagement plate 51 having been pressed by the engagement releasing plate 60 and slid upstream slides downstream, and thus the engagement reception pin 71 engages with the first engagement slit hole 53. Through this operation, the guide member 30 is displaced and fixed to the first supporting position.

Next, a case where the guide member 30 is located at the second supporting position is described.

Figure 7:
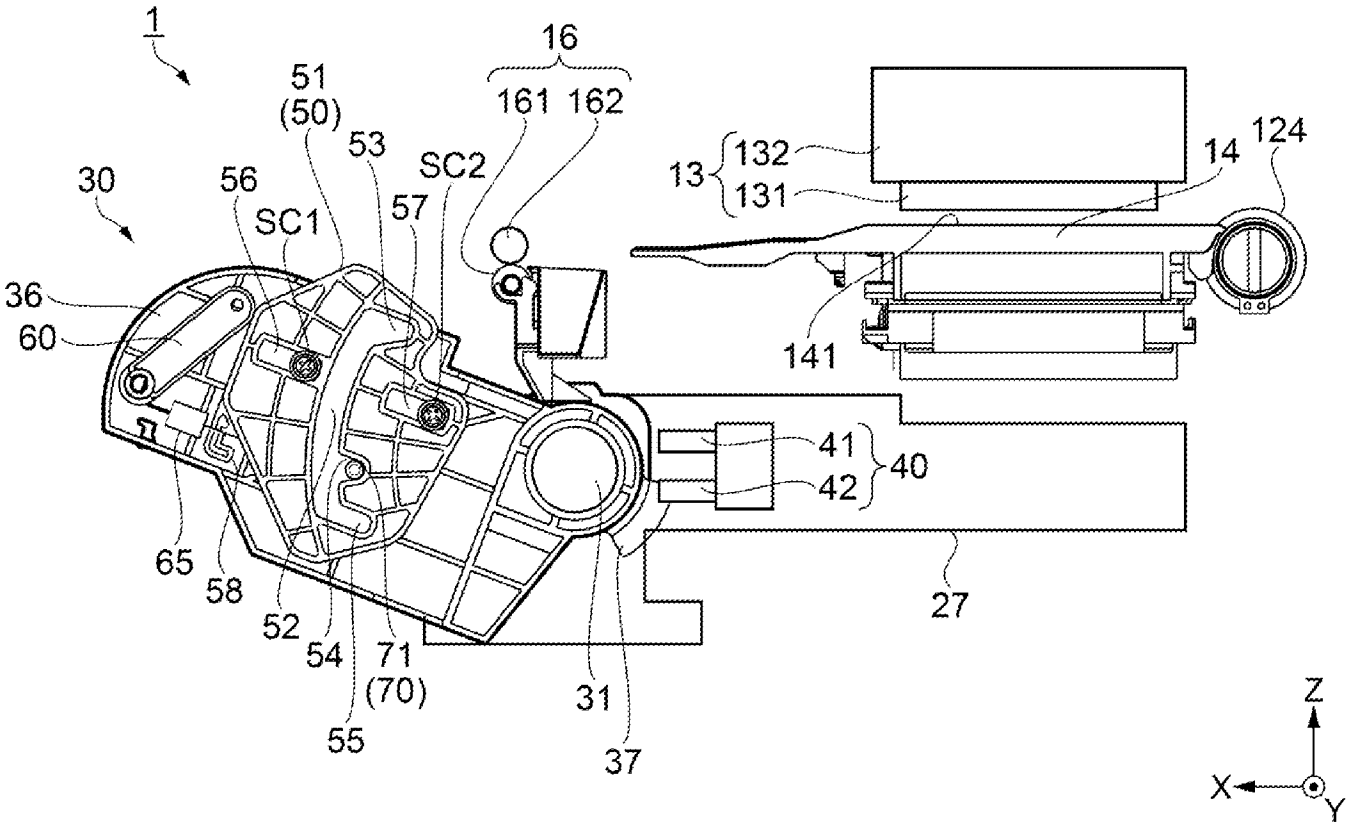
FIG. 7 is a schematic side view illustrating a second supporting position of the guide member.

FIG. 7 illustrates a case where the guide member 30 is located at the second supporting position. Note that the second supporting position is located above the first supporting position.

The second supporting position is a position for a case where the long medium S with a large bending rigidity such as photographic paper sent out from the roll sheet R is guided. The long medium S on which recording has been performed is wound around the core member 25 provided with the holding member 26 provided at the upper holding unit 112 of the housing unit 11 at a position on the lower side (the downstream side in the conveyance direction A) of the guide member 30. Note that the core member 25 provided with the holding member 26 and the like constitute the winding unit 18. At the second supporting position, the engagement plate 51 of the guide member 30 engages the engagement reception pin 71 in the second engagement slit hole 54.

To displace the guide member 30 from the first supporting position to the second supporting position, the engagement of the first supporting position (the engagement of the first engagement slit hole 53 and the engagement reception pin 71) is released by inserting a hand into the handle 38 of the guide member 30, pulling the lever, and rotating the engagement releasing plate 60 so as to slide the engagement plate 51 in the same manner as that described above.

Thereafter, when the guide member 30 is turned up and the engagement reception pin 71 is positioned at the position of the displacement slit hole 52 coupled with the second engagement slit hole 54, the engagement releasing plate 60 is returned to the initial position with the pulling force of the coil spring 65. Additionally, the engagement plate 51 having been pressed by the engagement releasing plate 60 and slid upstream slides downstream, and thus the engagement reception pin 71 engages with the second engagement slit hole 54. Through this operation, the guide member 30 is displaced and fixed to the second supporting position.

Note that as illustrated in FIG. 4, in the engagement plate 51 of the present embodiment, the first engagement slit hole 53 is coupled with the displacement slit hole 52 with a tapered portion T1 that has a lower external shape sloping and widening downward. With this shape, by inserting a hand into the handle 38 of the guide member 30 and raising up the handle 38 as is without pulling the lever, the engagement reception pin 71 can slide along the tapered portion T1 of the first engagement slit hole 53 and move to the displacement slit hole 52.

Thus, the user can displace the guide member 30 from the first supporting position to the second supporting position by inserting their hand into the handle 38 of the guide member 30 and raising it upward as is. In other words, when displacing (lifting) the guide member 30 from the first supporting position to the second supporting position, it can be displaced without releasing the engagement at the engagement releasing plate 60. Note that when displacing (lowering) the guide member 30 from the second supporting position to the first supporting position, it is displaced by releasing the engagement at the engagement releasing plate 60 as usual.

Note that the second supporting position is a position not only for guiding the long medium S with a large bending rigidity such as photographic paper, but also for supporting a single sheet such as single sheet paper or cardboard in the case where the single sheet medium is supplied to the recording unit 13 from the downstream side to the upstream side in the conveyance direction A (the direction opposite to the conveyance direction A) without using the roll sheet R.

Specifically, in the present embodiment, a single sheet medium such as single sheet paper or cardboard can be conveyed from the outlet 171 toward the recording unit 13 in the direction opposite to the conveyance direction A. In this case, each roller rotates to convey the single sheet medium in the direction opposite to the conveyance direction A. Further, when a single sheet medium is inserted from the outlet 171, the guide member 30 fixed to the second supporting position supports the single sheet medium.

Note that an upstream end portion of a supplied single sheet medium such as single sheet paper or cardboard is once put out of the apparatus from the rear surface side of the housing 10, and then subjected to recording by being conveyed in the conveyance direction A. The single sheet medium such as single sheet paper or cardboard on which recording has been performed is again ejected from the outlet 171 while supported by the guide member 30.

Next, a case where the guide member 30 is located at the open position is described.

Figure 8:
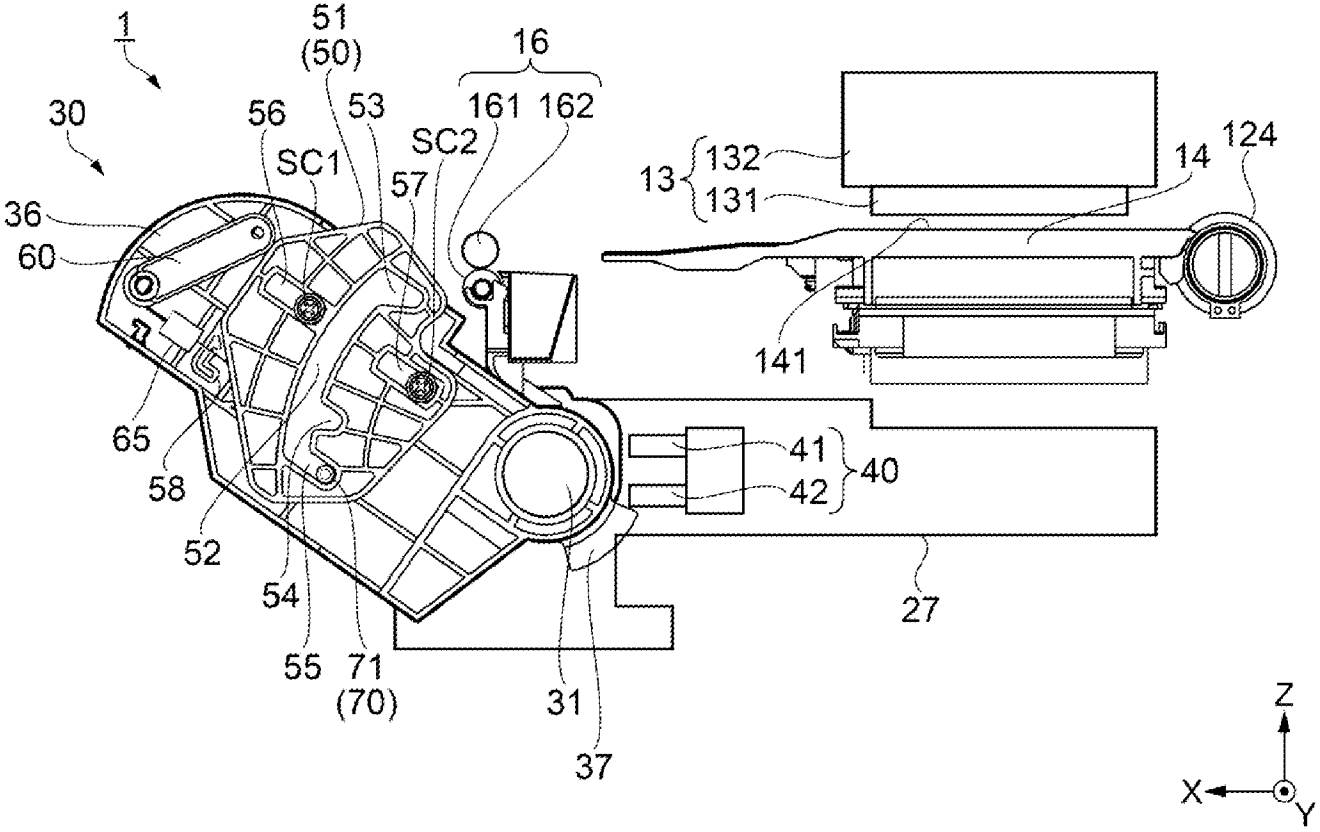
FIG. 8 is a schematic side view illustrating an open position of the guide member.

FIG. 8 illustrates a case where the guide member 30 is located at the open position. Note that the open position is located above the second supporting position.

The open position is a position where the guide member 30 substantially closes the outlet 171. Therefore, when the guide member 30 is located at the open position, the recording medium is not ejected. When the guide member 30 is located at the open position, the lower side of the guide member 30 is open, and the inside of the recording apparatus 1 is accessible.

Specifically, a liquid waste box 90 for maintenance is detachably provided on the lower side of the guide member 30 inside the recording apparatus 1. The liquid waste box 90 can be detached from the recording apparatus 1 by displacing the guide member 30 to the open position and pulling out the liquid waste box 90 to the front side. In addition, the liquid waste box 90 can be attached to the original position. At the open position, the engagement plate 51 of the guide member 30 engages the engagement reception pin 71 in the third engagement slit hole 55.

To displace the guide member 30 from the second supporting position to the first supporting position, the engagement of the second supporting position (the engagement of the second engagement slit hole 54 and the engagement reception pin 71) is released by inserting a hand into the handle 38 of the guide member 30, pulling the lever, and rotating the engagement releasing plate 60 so as to slide the engagement plate 51 in the same manner as that described above.

Thereafter, when the guide member 30 is turned up and the engagement reception pin 71 hits the lower end portion of the displacement slit hole 52, the engagement reception pin 71 is positioned at the third engagement slit hole 55 coupled with the lower end portion of the displacement slit hole 52, and the engagement releasing plate 60 is returned to the initial position with the pulling force of the coil spring 65. Additionally, the engagement plate 51 having been pressed by the engagement releasing plate 60 and slid upstream slides downstream, and thus the engagement reception pin 71 engages with the third engagement slit hole 55. Through this operation, the guide member 30 is displaced and fixed to the open position.

Note that as illustrated in FIG. 4, in the engagement plate 51 of the present embodiment, the second engagement slit hole 54 is coupled with the displacement slit hole 52 with a tapered portion T2 that has a lower external shape sloping and widening downward. With this shape, by inserting a hand into the handle 38 of the guide member 30 and raising up the handle 38 as is without pulling the lever, the engagement reception pin 71 can slide along the tapered portion T2 of the second engagement slit hole 54 and move to the displacement slit hole 52.

Thus, the user can displace the guide member 30 from the second supporting position to the open position by inserting their hand into the handle 38 of the guide member 30 and raising it upward as is. In other words, when displacing (lifting) the guide member 30 from the second supporting position to the open position, the guide member 30 can be displaced without releasing the engagement at the engagement releasing plate 60. Note that when displacing (lowering) the guide member 30 from the open position to the second supporting position, it is displaced by releasing the engagement at the engagement releasing plate 60 as usual.

Figure 9:
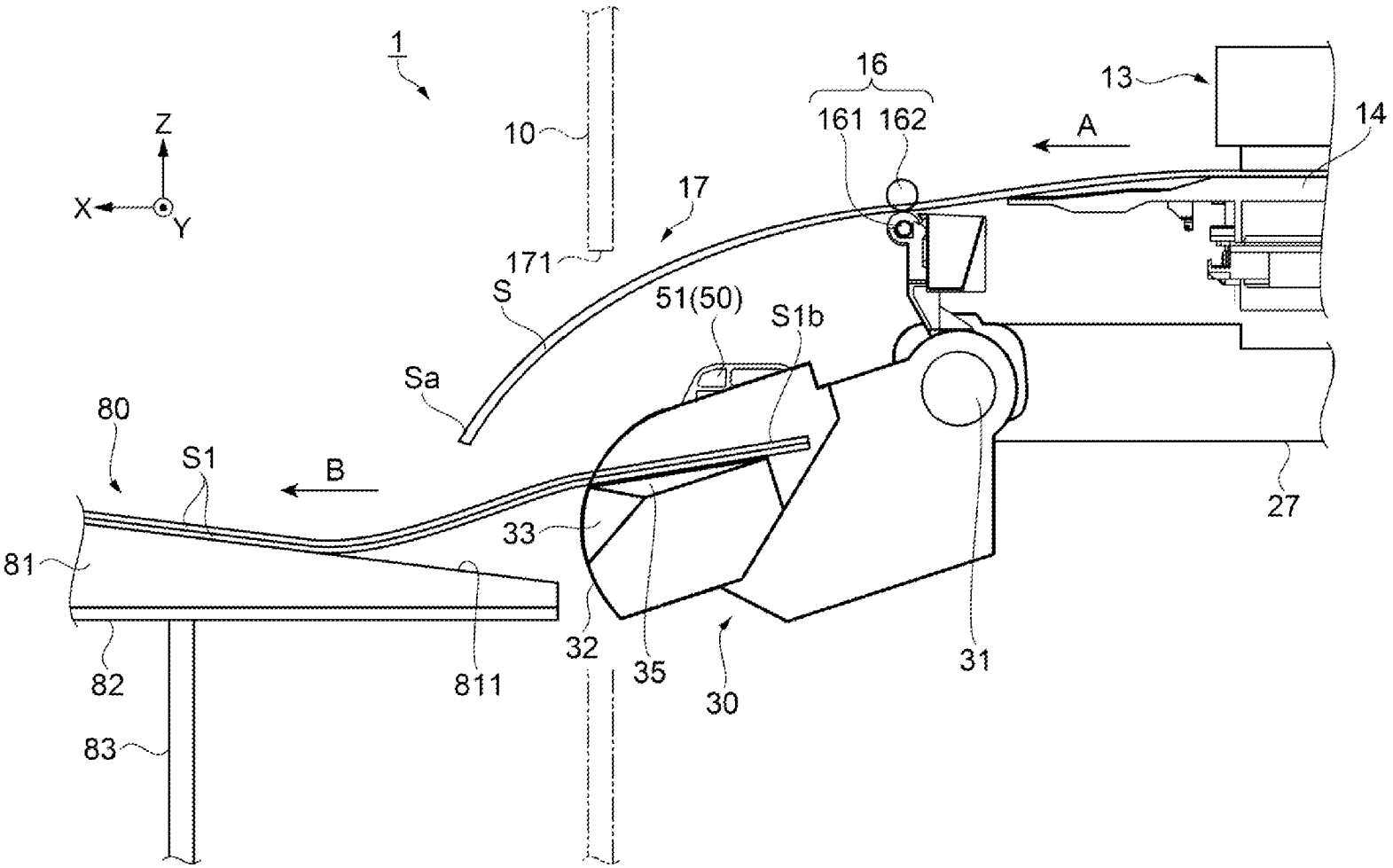
FIG. 9 is a side sectional view illustrating ejection of a recording medium in a case where the guide member is located at the first supporting position.

FIG. 9 is a side sectional view illustrating ejection of a recording medium in a case where the guide member 30 is located at the first supporting position. An ejection operation of the long medium S (the single sheet medium S1) in a case where the guide member 30 is located at the first supporting position is described below.

By positioning the guide member 30 at the first supporting position, the single sheet medium S1 that is ejected to the side lower than the position where the supporting part 14 supports the recording medium is supported and guided to a large capacity stacker 80 serving as a medium housing unit. As illustrated in FIG. 9, the large capacity stacker 80 is detachably attached to the housing 10 at a position downstream of the guide member 30 in the conveyance direction A. In addition, the large capacity stacker 80, which is provided below the first supporting position of the guide member 30, houses the single sheet medium S1.

As illustrated in FIG. 9, the large capacity stacker 80 includes a loading unit 81 for sequentially loading the single sheet medium S1 ejected from the sheet ejection unit 17 in the case where the roll sheet R is used, a plurality of loading frames 82 that support the loading unit 81, and leg frames 83, e.g., four leg frames 83, that extend in the height direction and receive the plurality of loading frames 82. A caster (omitted in the drawing) is attached at a lower end portion of each of the leg frames 83, and thus the large capacity stacker 80 can move. In addition, a loading surface 811 that receives the single sheet medium S1 is configured in the loading unit 81. Note that the loading surface 811 is configured as a tilted surface that gently rises along the ejection direction B as illustrated in FIG. 9.

FIG. 9 illustrates a state where the single sheet medium S1 that is ejected immediately before is loaded on the large capacity stacker 80 attached to the recording apparatus 1. When the ejected single sheet medium S1 is loaded on the loading surface 811 of the large capacity stacker 80, a rear end portion Sib as an end portion of the single sheet medium S1 on the upstream side in the conveyance direction A (the ejection direction B) is sequentially loaded in the state where it is located on the third guide part 35 of the guide member 30.

In other words, when the guide member 30 is located at the first supporting position, the guide member 30 constitutes a part of the loading surface 811 when the single sheet medium S1 is loaded on the large capacity stacker 80. To put it another way, the guide member 30 constitutes a part of the loading path.

A front end portion Sa as the downstream end portion in the conveyance direction A of the long medium S that is being conveyed next is sandwiched by the ejection roller pair 16 and ejected in the ejection direction B from the outlet 171. In this case, the front end portion Sa of the long medium S hangs down, and is ejected while being curved upward in a side view. Then, when the front end portion Sa of the long medium S comes closer to the loading surface 811 and makes contact with the single sheet medium S1 that has been loaded, the end portion Sa moves in the ejection direction B while sliding along the surface of the single sheet medium S1 that has been loaded.

When the recording is completed and the long medium S has a predetermined length, the long medium S is cut by the cutting part 15 into the single sheet medium S1, and the single sheet medium S1 is ejected from the outlet 171. In this case, the rear end portion Sib of the ejected single sheet medium S1 is loaded in the same position at the top of the rear end portion Sib of the single sheet medium S1 loaded on the third guide part 35 of the guide member 30.

FIG. 10 is a side sectional view illustrating ejection of a recording medium in a case where the guide member 30 is located at the second supporting position. An ejection operation of the long medium S in a case where the guide member 30 is located at the second supporting position is described below.

By positioning the guide member 30 at the second supporting position, the long medium S recorded using the roll sheet R can be wound by the winding unit 18 without cutting it. Note that when the guide member 30 is positioned at the second supporting position, the guide member 30 is set to a state where it supports the long medium S at a position substantially the same as the height position where the supporting part 14 supports the long medium S, and guides it to the winding unit 18. Likewise, when the guide member 30 is positioned at the second supporting position, the guide member 30 is set in a state where it supports the long medium S at a position substantially the same as the height position where the ejection roller pair 16 sandwiches the long medium S and guides it to the winding unit 18.

With the above-described positional relationship, the downward movement of the long medium S between the supporting part 14 and the guide member 30 is prevented. In addition, in particular, the driving roller 161 as the lower roller in the ejection roller pair 16 has a large curvature, and thus, by supporting the long medium S at a position substantially the same as the height position where the ejection roller pair 16 sandwiches the long medium S, the long medium S is prevented from being moved downward and wound around the driving roller 161 having the large curvature. In this manner, the quality of the long medium S is maintained.

In the present embodiment, the winding unit 18 is provided at the upper holding unit 112 on the downstream side in the conveyance direction A in the housing unit 11 on the lower side of the guide member 30. In addition, the winding unit 18 is composed of a winding roll body R1 composed of the core member 25 provided with the holding member 26 and the like, a driving unit (omitted in the drawing) that rotates the winding roll body R1 in a winding direction C, and the like.

The long medium S is wound in synchronization with the conveyance of the long medium S with a tension applied thereto between the driving roller 161 of the ejection roller pair 16, the guide surface 30*a* as a curved surface of the first guide part 32 and the second guide part 33 of the guide member 30, and the winding roll body R1.

As described above, the recording medium wound by the winding unit 18 in the present embodiment is the long medium S with a large bending rigidity such as photographic paper. Note that the roll sheet R provided at the lower holding unit 112 in the housing unit 11 and configured to supply the recording medium to the recording unit 13 is a roll of photographic paper.

Note that in the guide member 30, the guide surface 30*a* of the first guide part 32 and the second guide part 33 guides, in a sliding manner, the long medium S being conveyed. Further, as described above, the curvature of the curved surface (the guide surface 30*a*) of the first guide part 32 and the second guide part 33 of the guide member 30 is smaller than the curvature of the outer periphery of the driving roller 161, which is the lower roller of the ejection roller pair 16.

In addition, the photographic paper includes a coating layer for enhancing the image quality on the recording surface. The coating layer has a property of easily cracking when the coating layer is supported and slid on a member having a large curvature (a member whose curved surface has a small radius). In the present embodiment, when supported and slid on the curved surface of the driving roller 161, the coating layer easily cracks.

However, the coating layer does not crack when the coating layer is supported and slid on the guide surface 30*a* of the first guide part 32 and the second guide part 33 of the guide member 30 of the present embodiment. In other words, the curvature of the guide surface 30*a* of the first guide part 32 and the second guide part 33 of the guide member 30 is set to a curvature that does not cause cracking of the coating layer on the basis of an experiment conducted by the present inventors and the like.

Figure 11:
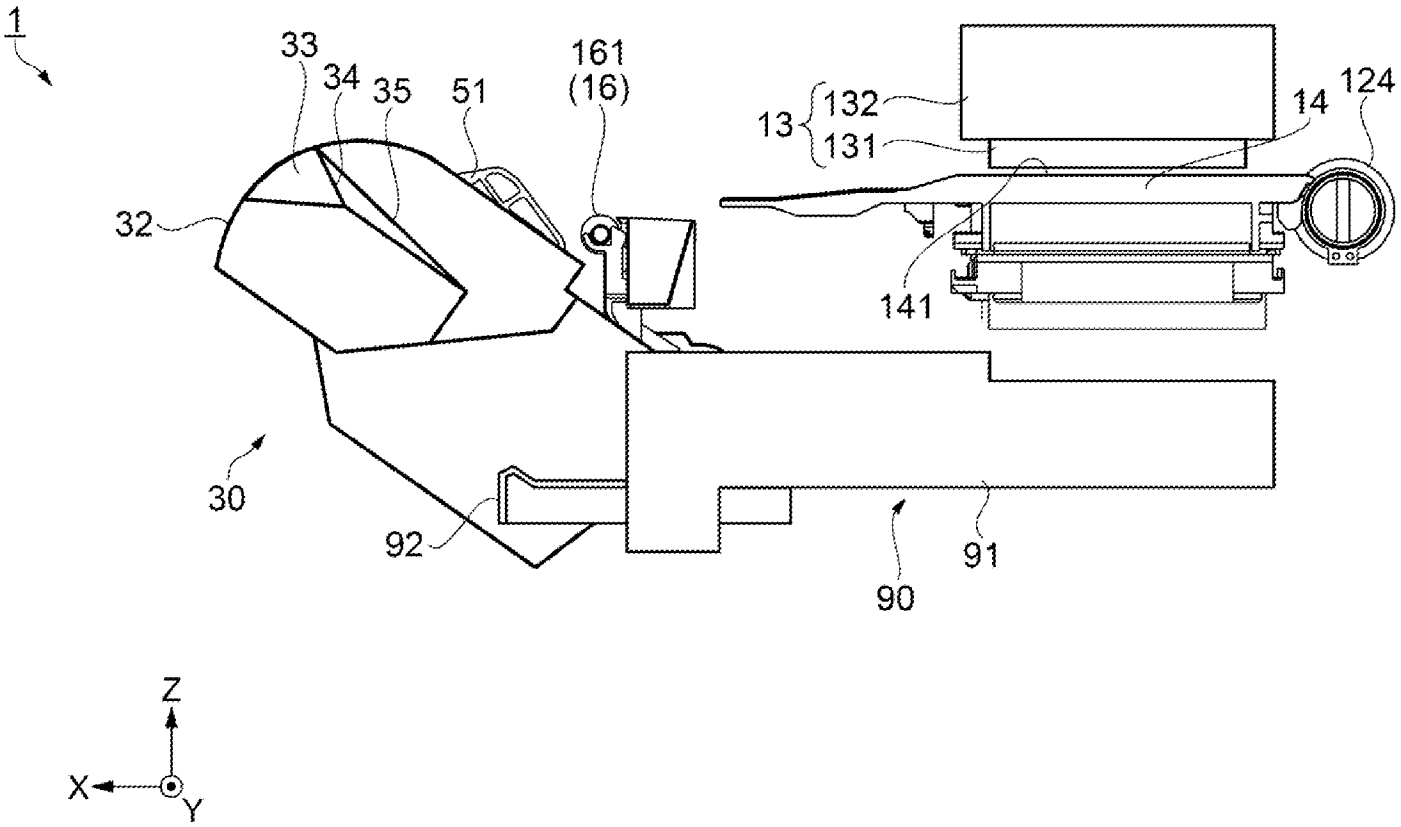
FIG. 11 is a side sectional view illustrating a liquid waste box in a case where the guide member is located at the open position.

FIG. 11 is a side sectional view of a case where the guide member 30 is located at the open position. A case where the guide member 30 is located at the open position is described below.

By positioning the guide member 30 at the open position, the liquid waste box 90 for maintenance can be detached and attached. With the liquid waste box 90, when frameless printing is performed on the recording medium, the ink discharged to the outside of both end portions of the recording medium in the width direction is collected in a channel (omitted in the drawing) and the like and carried into the liquid waste box 90. Each liquid waste box 90 is detachably provided on the lower side of the end portion of the guide member 30 in the width direction and on the lower side of the supporting part 14.

The liquid waste box 90 is generally composed of a box-shaped housing unit 91 that houses the liquid waste, and a handle part 92 on the front side of the housing unit 91. In addition, the liquid waste box 90 is supported by a frame (omitted in the drawing) such that it is movable in the front-rear direction.

When the guide member 30 is displaced to the open position, a state where the outlet 171 is closed is set. Further, a state where the liquid waste box 90 inside the recording apparatus 1 is exposed on the front surface side of the housing 10 and on the lower side of the guide member 30 is set. In this state, the user can detach the liquid waste box 90 from the recording apparatus 1 by placing their fingertips on the handle part 92 on the front side of the liquid waste box 90 and pulling it forward. In addition, the user can attach the liquid waste box 90 as a replacement to the original position through a reverse procedure which is the reverse of the detaching procedure.

Next, with reference to FIGS. 5, 7, and 8, a sensor that detects the supporting position of the guide member 30, and the control unit 24 are described below.

The recording apparatus 1 of the present embodiment includes the detection sensor 40 that detects three positions, the first supporting position, the second supporting position, and the open position, to which the guide member 30 is displaced. The detection sensor 40 is composed of two sensors, a first detection sensor 41 and a second detection sensor 42.

The detection sensor 40 is an optical sensor. The first detection sensor 41 receives light emitted from a light emission part at a light reception part facing the light emission part. The second detection sensor 42 has the same configuration as that of the first detection sensor 41. In the present embodiment, "OFF" represents a case where light has been received, and "ON" represents a case where light has not been received. In addition, in the detection sensor 40, the first detection sensor 41 and the second detection sensor 42 are provided on the upper side and lower side in such a manner as to sandwich the light shielding plate 37 formed upstream of the end portion 36 of the guide member 30.

As illustrated in FIG. 5, when the guide member 30 is located at the first supporting position, the light shielding plate 37 blocks light for both the first detection sensor 41 and the second detection sensor 42. Accordingly, both the first detection sensor 41 and the second detection sensor 42 are set to the "ON" state. When the guide member 30 is located at the second supporting position as illustrated in FIG. 7, the light shielding plate 37 does not block the light for the first detection sensor 41, but blocks the light for the second detection sensor 42. Accordingly, the first detection sensor 41 is set to "OFF" and the second detection sensor 42 is set to "ON". In addition, as illustrated in FIG. 8, when the guide member 30 is located at the open position, the light shielding plate 37 does not block the light for both the first detection sensor 41 and the second detection sensor 42. Accordingly, both the first detection sensor 41 and the second detection sensor 42 are set to the "OFF" state.

When the input command of the output mode from the operation panel 20 and the detection results of the detection sensors 40 are different from each other, the control unit 24 can display and notify the information to the user through the operation panel 20, an indicator (omitted in the drawing), a sound notification unit (omitted in the drawing), and the like.

According to the present embodiment, the following effects can be achieved.

The recording apparatus 1 of the present embodiment includes the recording unit 13 configured to perform recording on a recording medium that is a long medium having a roll shape, the supporting part 14 disposed opposite to the recording unit 13 and configured to support the recording medium, and the cutting part 15 configured to cut the long medium S into the single sheet medium S1 at a position downstream of the supporting part 14. In addition, the recording apparatus 1 includes the guide member 30 configured to guide the recording medium at a position downstream of the cutting part 15, the winding unit 18 configured to wind up the long medium S at a position downstream of the guide member 30, and the large capacity stacker 80 serving as a medium housing unit configured to be detachable and house the single sheet medium S1 at a position downstream of the guide member 30. The guide member 30 is displaceable to the first supporting position in which the guide member 30 supports the recording medium being conveyed to the large capacity stacker 80, and the second supporting position in which the guide member 30 supports the long medium S being conveyed to the winding unit 18. The second supporting position is located above the first supporting position.

With this configuration, the guide member 30 is displaced to the first supporting position, and supports the recording medium being conveyed to the large capacity stacker 80. In addition, the guide member 30 is displaced to the second supporting position located above the first supporting position, and supports the long medium S being conveyed to the winding unit 18. Thus, the guide member 30 can perform appropriate ejection in accordance with the ejection destination of the medium, the characteristics of the medium and/or the like.

In the recording apparatus 1 of the present embodiment, when the guide member 30 is positioned at the first supporting position, the guide member 30 supports and guides, to the large capacity stacker 80, the single sheet medium S1 ejected to a side lower than a position where the supporting part 14 supports the recording medium.

With this configuration, by disposing the guide member 30 at the first supporting position when the single sheet medium S1 is ejected below the supporting part 14 that supports the recording medium, it is possible to prevent the blockage of the path for guiding the medium to the large capacity stacker 80 provided at a low position.

In the recording apparatus 1 of the present embodiment, the large capacity stacker 80 is provided below the first supporting position of the guide member 30 to house the single sheet medium S1.

With this configuration, the single sheet medium S1 can be stably guided to the large capacity stacker 80, and a plurality of the single sheet media S1 can be housed.

In the recording apparatus 1 of the present embodiment, when the guide member 30 is disposed at the second supporting position, the guide member 30 supports and guides, to the winding unit 18, the long medium S at a height position where the supporting part 14 supports the recording medium.

With this configuration, the downward movement of the recording medium in a region from the supporting part 14 to the guide member 30 can be prevented, and the quality of the recording medium to be wound up can be ensured.

The recording apparatus 1 of the present embodiment includes the ejection roller pair 16 at a position downstream of the cutting part 15, and the curvature of the guide surface 30*a* of the guide member 30 that guides the long medium S is set to a value smaller than that of the curvature of the outer periphery of the driving roller 161 disposed on the lower side in the ejection roller pair 16.

With this configuration, when the long medium S slides on the guide surface 30*a* of the guide member 30 that guides the long medium S, the quality of the long medium S can be ensured. In particular, in the case where photographic paper is wound up, the coating layer of the photographic paper can be protected.

In the recording apparatus 1 of the present embodiment, in a state where the guide member 30 is disposed at the second supporting position, the guide member 30 guides the long medium S at a height position where the ejection roller pair 16 sandwiches the long medium S. With this configuration, the guide member 30 guides the long medium S at the height position where the ejection roller pair 16 sandwiches the long medium S, and thus winding of the long medium S around the driving roller 161 as the lower roller in the ejection roller pair 16 can be suppressed.

In the recording apparatus 1 of the present embodiment, in a state where the guide member 30 is disposed at the second supporting position, the guide member 30 supports the single sheet medium when a single sheet medium such as single sheet paper or cardboard is supplied to the recording unit 13 from the downstream side in the conveyance direction A.

With this configuration, by supplying the single sheet medium (such as single sheet paper or cardboard) from the downstream side to the upstream side in the conveyance direction A (in the direction opposite to the conveyance direction A) to the recording unit 13 in the state where the guide member 30 is disposed at the second supporting position, the single sheet medium can be easily supplied in comparison with a case where the single sheet medium is supplied from the downstream side to the upstream side to the recording unit 13 in the conveyance direction A in the state where it is positioned at the first supporting position. Thus, when the medium is supplied from the downstream side to the upstream side in the conveyance direction A, the supply in the direction opposite to the conveyance direction A can be stabilized with the guide member 30 disposed at a proper position.

In the recording apparatus 1 of the present embodiment, the guide member 30 is displaceable to the open position where the inside of the recording apparatus 1 is accessible at a position above the second supporting position. In particular, in the present embodiment, the liquid waste box 90 becomes accessible, and the liquid waste box 90 can be attached and detached.

With this configuration, the convenience of the guide member 30 can be improved. In addition, as with the operation of the guide member 30, the liquid waste box 90 can be operated (attached/detached) from the front side, thus improving the operation efficiency.

In the recording apparatus 1 of the present embodiment, the guide member 30 includes the turning shaft 31 at a position on the upstream side in the conveyance direction A, and the guide member 30 is displaced by being rotated around the turning shaft 31.

With this configuration, when the guide member 30 is displaced, the guide member 30 can be rotated around the turning shaft 31, and thus the guide member 30 can be smoothly displaced.

The recording apparatus 1 of the present embodiment includes the detection sensor 40 configured to detect the position of the guide member 30, and a notification is made when there is a mismatch between the position of the guide member 30 and the output mode.

With this configuration, the position of the guide member 30 and the output mode can be matched even when the guide member 30 is manually displaced. In addition, an unexpected change in the position of the guide member 30 and the like can be appropriately handled.

The recording apparatus 1 of the present embodiment includes the engaging part 50 provided in the guide member 30, and the engagement reception part 70 provided inside the recording apparatus 1 and configured to receive the engaging part 50, and when the engaging part 50 is engaged with the engagement reception part 70, the guide member 30 is positioned at each position.

With this configuration, the guide member 30 is fixed at a proper position, and can keep that position.

2. Modification 1

In the present embodiment, the single sheet medium S1 is ejected using the large capacity stacker 80 in a state where the guide member 30 is located at the first supporting position. However, this is not limitative, and the single sheet medium S1 ejected from the outlet 171 may be received by the user without using the large capacity stacker 80. In addition, the single sheet medium S1 ejected from the outlet 171 may be housed in the net using the simple stacker 19 incorporated in the recording apparatus 1.

3. Modification 2

In the present embodiment, the recording medium wound by the winding unit 18 is the long medium S with a large bending rigidity such as photographic paper, but this is not limitative, and plain paper may be wound up.

4. Modification 3

In the present embodiment, when the guide member 30 is located at the second supporting position, the single sheet medium (such as single sheet paper or cardboard) can be supplied from the downstream side to the upstream side in the conveyance direction A (in the direction opposite to the conveyance direction A) to the recording unit 13. However, this is not limitative, and an opening (omitted in the drawing) may be provided on the rear surface side of the housing 10 such that the single sheet medium (such as single sheet paper or cardboard) is supplied from the opening to the recording unit 13.

5. Modification 4

In the present embodiment, the guide member 30 is manually displaced. However, this is not limitative, and it may be automatically displaced. In this case, it is possible to adopt a configuration including a control unit (omitted in the drawing) that controls the displacement of the guide member 30 and a driving unit (omitted in the drawing) that displaces the guide member to the first supporting position and the second supporting position, in which the control unit drives the driving unit in accordance with the characteristics of the recording medium to be ejected to displace the guide member to the first supporting position and the second supporting position. Note that the driving unit is composed of a motor, various gears, a link mechanism and the like, and the driving force is transmitted to the gear, the link mechanism, and the like with the rotation of the motor so as to displace the guide member 30.

This configuration eliminates the need for the user to manually displace the guide member, and the control unit can displace the guide member to the first supporting position and the second supporting position by driving the driving unit in accordance with the characteristics of the ejected recording medium. Additionally, displacement to the open position may also be performed.

6. Modification 5

In the above-mentioned modification 4, the control unit may determine the recording medium to be ejected, based on whether the cutting process is performed and/or whether the medium housing unit is attached. In this manner, the recording medium can be appropriately ejected in accordance with the characteristics of the recording medium.

What is claimed is:

1. A recording apparatus comprising:

a recording unit configured to perform recording on a recording medium that is a long medium having a roll shape;

a supporting part disposed opposite to the recording unit and configured to support the recording medium;

a cutting part configured to cut the long medium into a single sheet medium at a position downstream of the supporting part in a conveyance direction of the recording medium;

a guide member configured to guide the recording medium at a position downstream of the cutting part in the conveyance direction;

a winding unit configured to wind up the long medium at a position downstream of the guide member in the conveyance direction; and a medium housing unit configured to be detachable and house the single sheet medium at a position downstream of the guide member in the conveyance direction, wherein the guide member is displaceable to a first supporting position in which the guide member supports the recording medium being conveyed to the medium housing unit and a second supporting position in which the guide member supports the long medium being conveyed to the winding unit, the second supporting position being located above the first supporting position.

2. The recording apparatus according to claim 1, wherein when the guide member is disposed at the first supporting position, the guide member supports and guides, to the medium housing unit, the single sheet medium ejected to a side lower than a position where the supporting part supports the recording medium.

3. The recording apparatus according to claim 2, wherein the medium housing unit is provided at a position lower than the first supporting position of the guide member to house the single sheet medium.

4. The recording apparatus according to claim 1, wherein when the guide member is disposed at the second supporting position, the guide member supports and guides, to the winding unit, the long medium at a height position where the supporting part supports the recording medium.

5. The recording apparatus according to claim 1, comprising an ejection roller pair at a position downstream of the cutting part, wherein a curvature of a guide surface of the guide member configured to guide the long medium is smaller than a curvature of an outer periphery of a roller disposed on a lower side in the ejection roller pair.

6. The recording apparatus according to claim 5, wherein in a state where the guide member is disposed at the second supporting position, the guide member guides the long medium at a height position where the ejection roller pair sandwiches the long medium.

7. The recording apparatus according to claim 1, wherein in a state where the guide member is disposed at the second supporting position, the guide member supports the single sheet medium when the single sheet medium is supplied to the recording unit from a downstream side in the conveyance direction.

8. The recording apparatus according to claim 1, wherein the guide member is displaceable to an open position where the inside of the recording apparatus is accessible, the open position being located above the second supporting position.

9. The recording apparatus according to claim 1, wherein the guide member includes a turning shaft at a position on an upstream side in the conveyance direction, and the guide member is displaced by being rotated around the turning shaft.

10. The recording apparatus according to claim 1, comprising a detection sensor configured to detect a position of the guide member, wherein a notification is made when there is a mismatch between the position of the guide member and an output mode.

11. The recording apparatus according to claim 1, comprising:

an engaging part provided in the guide member; and an engagement reception part provided inside the recording apparatus and configured to receive the engaging part, wherein the guide member is positioned at each position when the engaging part is engaged with the engagement reception part.

12. The recording apparatus according to claim 1, comprising:

a control unit configured to control a displacement of the guide member; and a driving unit configured to displace the guide member to the first supporting position and the second supporting position, wherein the control unit displaces the guide member to the first supporting position and the second supporting position by driving the driving unit in accordance with characteristics of the recording medium to be ejected.

13. The recording apparatus according to claim 12, wherein the control unit determines the characteristics of the recording medium to be ejected, based on whether a cutting process is performed and/or whether the medium housing unit is attached.

* * * * *